US006481409B1

(12) United States Patent
Wade et al.

(10) Patent No.: US 6,481,409 B1
(45) Date of Patent: Nov. 19, 2002

(54) ELECTRO-HYDRAULIC CONTROL MODULE FOR DEACTIVATING INTAKE AND EXHAUST VALVES

(75) Inventors: Richard A. Wade, Shelby, NC (US); Edgar E. Roberts, Mount Holly, NC (US)

(73) Assignee: Fasco Controls, Inc., Shelby, NC (US)

( * ) Notice: Subject to any disclaimer, the term of this patent is extended or adjusted under 35 U.S.C. 154(b) by 31 days.

(21) Appl. No.: 09/820,414

(22) Filed: Mar. 29, 2001

Related U.S. Application Data

(60) Provisional application No. 60/193,121, filed on Mar. 30, 2000, and provisional application No. 60/197,728, filed on Apr. 18, 2000.

(51) Int. Cl.[7] ..... F02D 13/06
(52) U.S. Cl. ..... 123/198 F
(58) Field of Search ..... 123/198 F, 90.33, 123/90.38, 90.12

(56) References Cited

U.S. PATENT DOCUMENTS 4,401,068 A * 8/1983 Bristol ..... 123/198 F
4,414,935 A * 11/1983 Curtis et al. ..... 123/198 F
4,576,128 A * 3/1986 Kenichi ..... 123/198 F
5,460,129 A * 10/1995 Miller et al. ..... 123/198 F
5,619,958 A * 4/1997 Hampton et al. ..... 123/198 F
5,694,894 A * 12/1997 Allen ..... 123/198 F
6,138,636 A * 10/2000 Kohno et al. ..... 123/198 F
6,318,317 B1 * 11/2001 Hubschle ..... 123/198 F

* cited by examiner

*Primary Examiner*—Noah P. Kamen
*Assistant Examiner*—Jason Benton
(74) *Attorney, Agent, or Firm*—Pearne & Gordon LLP

(57) ABSTRACT

An electro-hydraulic control module for deactivating and reactivating intake and exhaust valves in an internal combustion engine comprising a series of stacked plates that form hydraulic valves, manifolding for supply, control and exhaust hydraulic flow and supports electromagnetic solenoids for activating the hydraulic valves. The plate structure is economical to manufacture and is advantageously small in vertical size. A bleed circuit keeps the hydraulic system relatively free of air to achieve fast, reliable and repeatable performance.

21 Claims, 11 Drawing Sheets

ELECTRO-HYDRAULIC CONTROL MODULE FOR DEACTIVATING INTAKE AND EXHAUST VALVES

This application claims priority of U.S. Provisional Application No. 60/193,121, filed Mar. 30, 2000, and U.S. Provisional Application No. 60/197,728, filed Apr. 18, 2000, the disclosures of which are incorporated herein by reference.

BACKGROUND OF THE INVENTION

The invention relates to apparatus for deactivating a limited number of cylinders in a multi-cylinder internal combustion engine.

PRIOR ART

Automotive engines have the ordinarily conflicting demands of providing high power capacity and good fuel economy. To achieve these needs, intake and exhaust valve deactivation to turn off some of the cylinders in a V-8 or V-6 engine has been attempted for a number of years. In the past, this approach has not been fully successful with consumers because the ability to rapidly respond to a vehicle's power needs has not always been reliable. With the evolution of a multitude of sensors in modern vehicles and the centralization of inputs from these sensors into the engine control module, a potential to execute this valve deactivation strategy in an engine exists.

To implement this strategy in a V-8 engine, up to four of the cylinders are deactivated at one time to effectively change the engine from a V-8 to a V-4. This reduction in the number of cylinders which are working results in reduced fuel consumption and hence improved fuel economy. The cylinders are turned off by locking the inlet and exhaust valves into the closed position. This stops air from entering or exiting the cylinders and by not turning on the fuel injectors, the cylinders are completely turned off. The inlet and exhaust valves are locked into the closed position by advancing a pin through the valve which mechanically holds the valves closed. This pin force is balanced by hydraulic pressure on one end and a coil spring on the other. A need exists for an economical, reliable and compact system for deactivating and reactivating the valves through these pins in a nearly instantaneous manner.

SUMMARY OF THE INVENTION

The invention provides an electro-hydraulic control module for deactivating sets of intake and exhaust valves in an internal combustion engine. The invention provides a module that is small in size, particularly in height, and is economical to manufacture and in operation is fast, reliable, and repeatable. The module employs relatively thin plates to provide hydraulic flow paths and to carry the hydraulic valve elements and actuating solenoids.

More specifically, the plates include so called "worm trails" or passages that transmit supply, exhaust, and control pressures to and from the control valves. The plates, which can be conveniently bolted across the top plane of the central valley of a V-shaped engine block such as in a V-8 engine, suspend the actuating solenoids in the valley space. The disclosed hydraulic valves, one for each engine cylinder to be deactivated, are located in low profile multiple purpose plate structures and use an inexpensive spherical ball as the valving element.

In each of the disclosed embodiments, the solenoids are electrically connected with conductors carried in a common rigid connector frame to simplify assembly procedures and reduce costs.

The invention provides a novel bleed circuit for reducing and, preferably, eliminating air from the hydraulic control passages in the module and the so-called "pin towers" in the engine that lead to the intake and exhaust valve disabling pin elements. The reduction in air in the control passages greatly improves the speed and repeatability of the hydraulic circuit. Speed and repeatability are important in the application of the present invention, because only a very short time is available with the engine running at moderate or high speed when the valves are motionless and thereby susceptible to be mechanically disabled in a shockless, i.e. smooth, manner. Repeatability or predictability of function of the disclosed circuitry of the module of the invention enables an engine control module to anticipate when the engine valves will be stationary and to initiate hydraulic valve actuation in the electro-hydraulic module at an appropriate time before then to assure that the hydraulic functions are completed within the available time.

DESCRIPTION OF THE PREFERRED EMBODIMENTS

Figure 1:
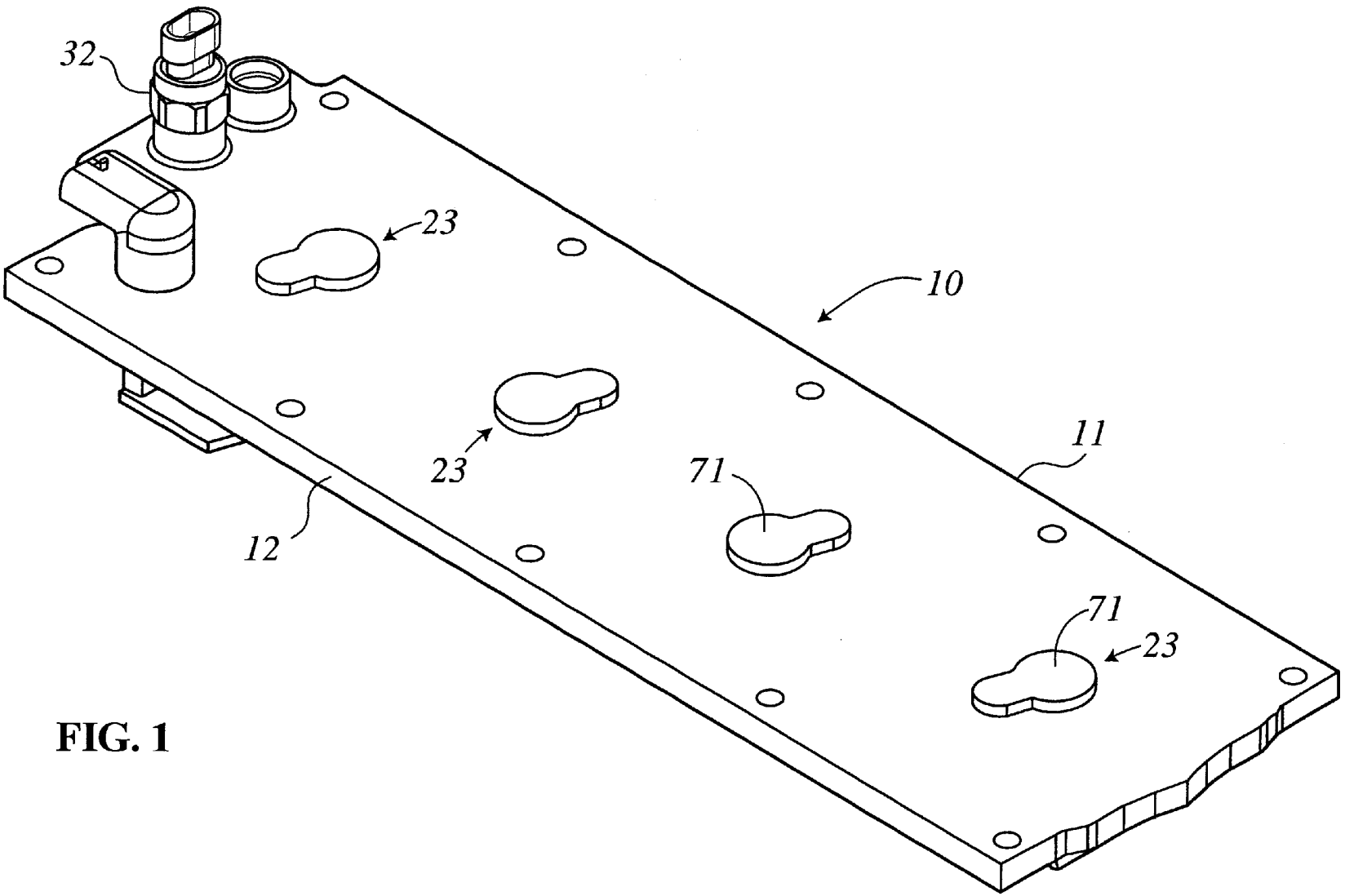
FIG. 1 is an isometric view of an electro-hydraulic control module for deactivating intake and exhaust valves of an internal combustion engine in accordance with a first embodiment of the invention.
Figure 2:
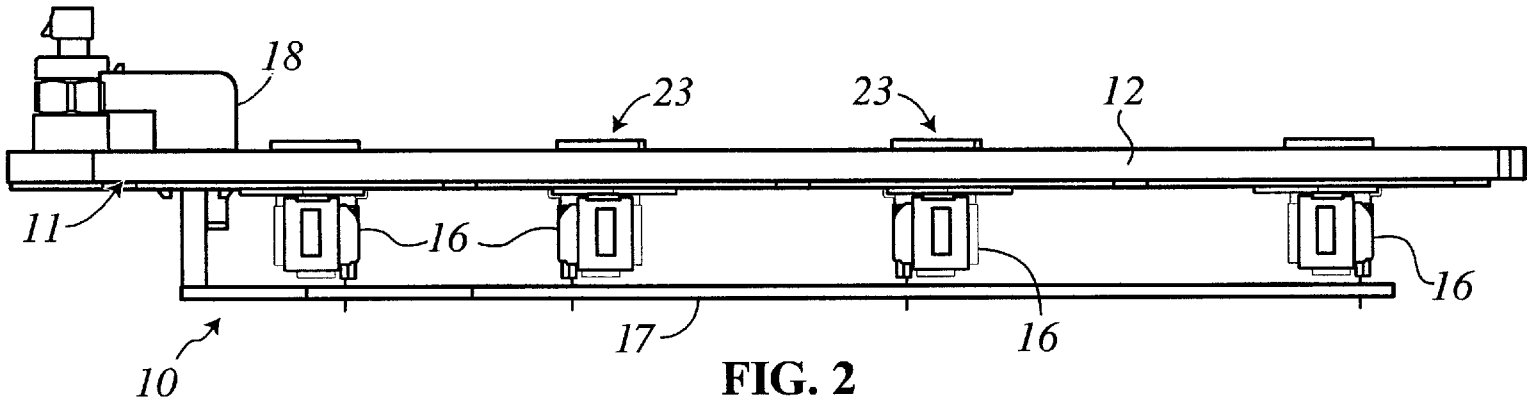
FIG. 2 is a side elevational view of the module of FIG. 1.

Referring now to the drawings and, in particular, to FIGS. 1 through 4, there is shown a electro-hydraulic control module 10 for valve deactivation in an internal combustion engine in accordance with a first embodiment of the invention. The module 10 includes a generally planar plate assembly 11. The term plate, when used as a noun herein, refers to a generally flat body that is relatively thin in one dimension compared to its size in the other two dimensions parallel to the plane of the body and that has planar surface areas on at least one face. The plate assembly 11 comprises, in sequence starting at the top with reference to the orientation of the assembly when it is installed on an engine, a top plate 12, a seal plate 13 and a gasket seal plate 21. The illustrated module 10 is arranged to be used on a V-8 engine and includes four hydraulic control valves (discussed below in connection with FIG. 11) individually actuated by respective electrical solenoids 16. The solenoids 16 are energized by voltage applied through electrical conductors in a connector frame 17 that mates with a connector 18 having electrical pins or blades within its shroud as is generally known.

Figure 5:
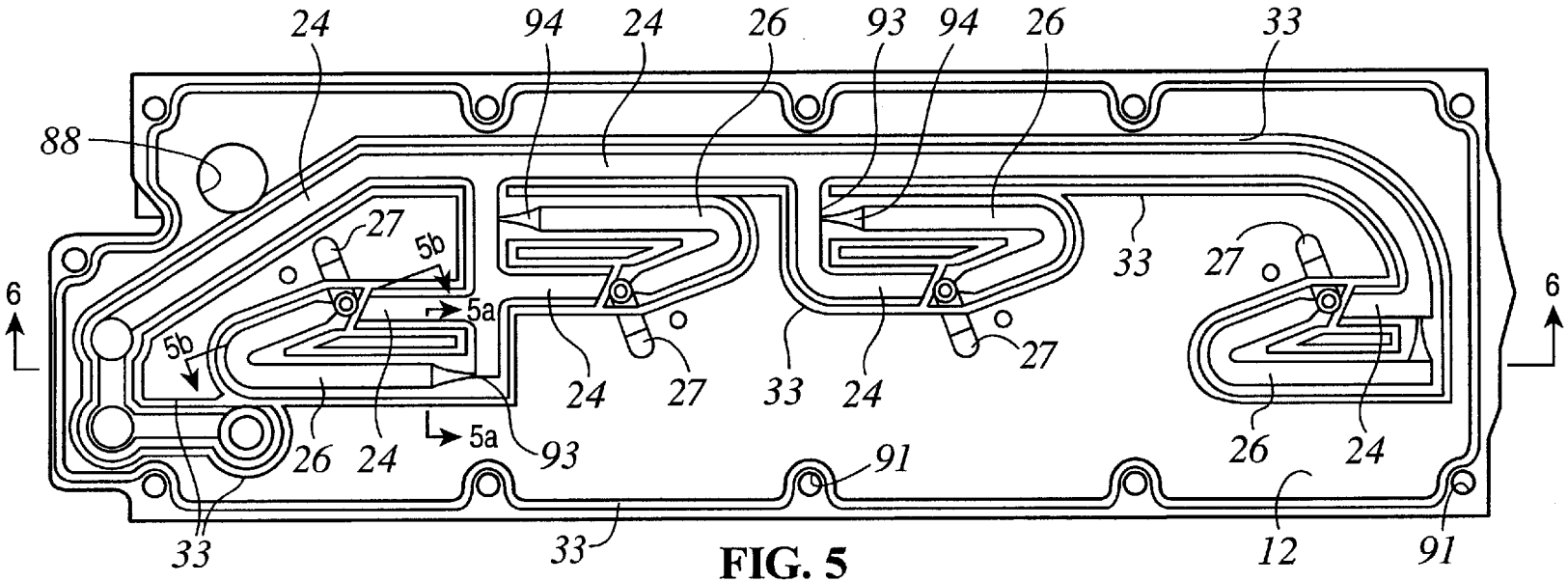
FIG. 5 is a bottom plan view of a top plate and exhaust plug assembly of the module of FIG. 1.

The top plate 12, which is preferably cast aluminum, has its lower side formed with grooves or "worm trails" that establish flow paths or passages for hydraulic oil, typically in this application engine lubrication oil, that serves to hydraulically operate elements for deactivating selected cylinders of the internal combustion engine on which the module 10 is mounted. The top plate 12 receives pressurized oil at a supply port 22. Supply pressure is conducted to centers 23 for valves described below in connection with FIG. 11 located above the solenoids 16 by trails 24 (FIG. 5). Control pressure from the valve centers 23 is conducted through trails 26. Exhaust for oil pressure is conducted from the valve centers or stations 23 through trails 27. A pressure relief valve 31, integrated in the top plate 12 and of a generally conventional construction using a ball and spring, limits oil pressure in the supply, control and exhaust trails 24, 26 and 27 by dumping excess oil pressure into the valley of the engine below the module 10. A pressure sensor 32, of known construction, transmits electrical signals indicating the pressure of oil in the supply trails 24 to the engine control module or computer. The pressure sensor 32 is threaded into or otherwise coupled to a port communicating with the supply trails 24. A filter (not shown) can be provided at the base of the sensor 32 to filter oil passing through the supply trail 24.

Narrow worm trails 33 formed along the perimeter and other interior paths parallel to the trails 24, 26 and 27 receive elastomeric sealant (not shown) that is preferably molded in place. The sealant in the interior trails seals the seal plate 13 with the top plate 12 thereby closing the otherwise open side of the grooves or trails 24, 26 and 27, converting these trails into independent closed hydraulic circuits.

Figure 3:
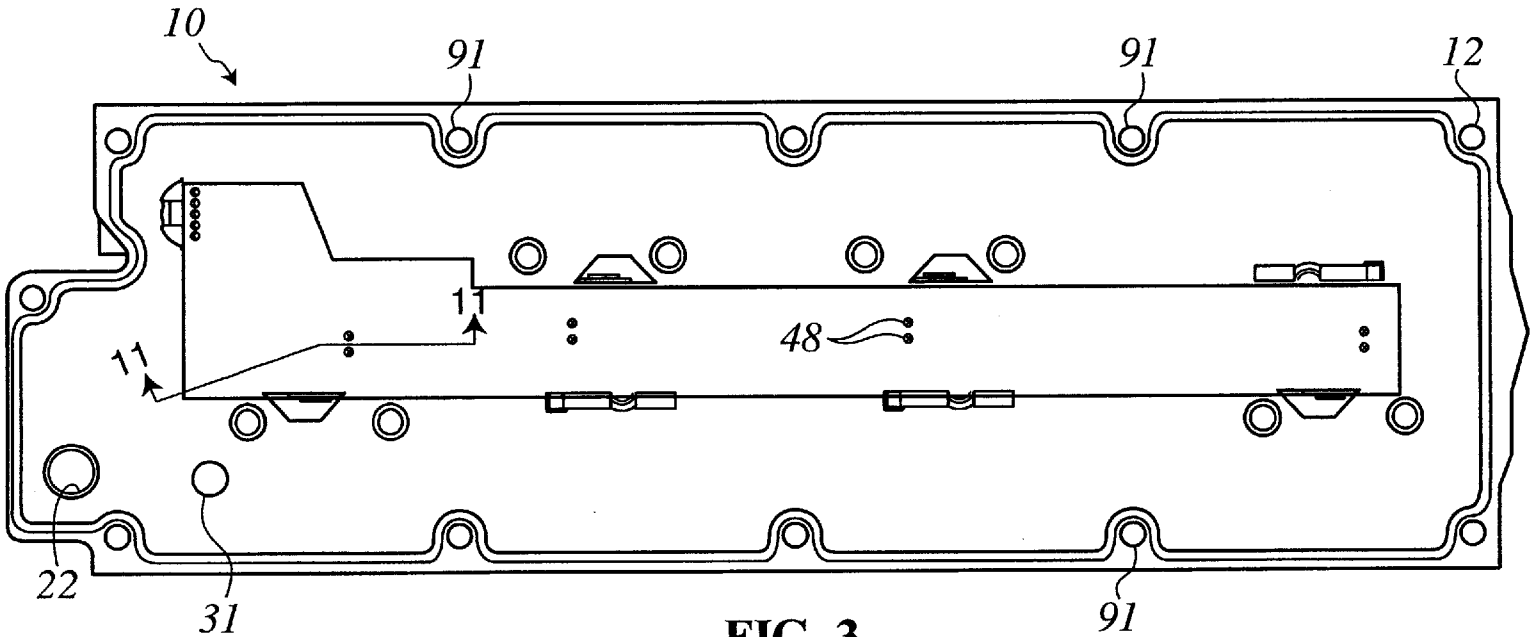
FIG. 3 is a bottom plan view of the module of FIG. 1.
Figure 4:
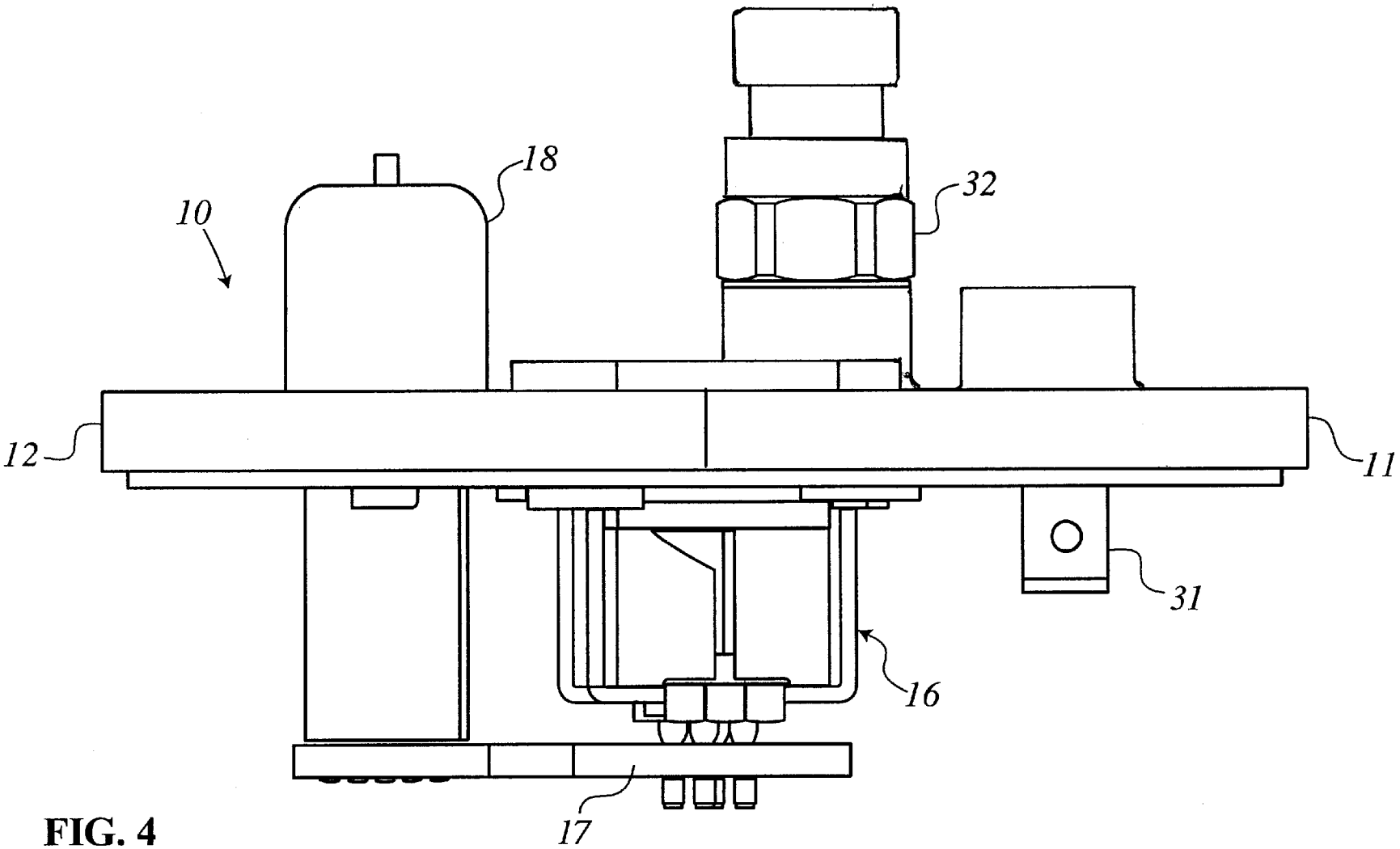
FIG. 4 is an end elevational view of the module of FIG. 1.
Figure 7:
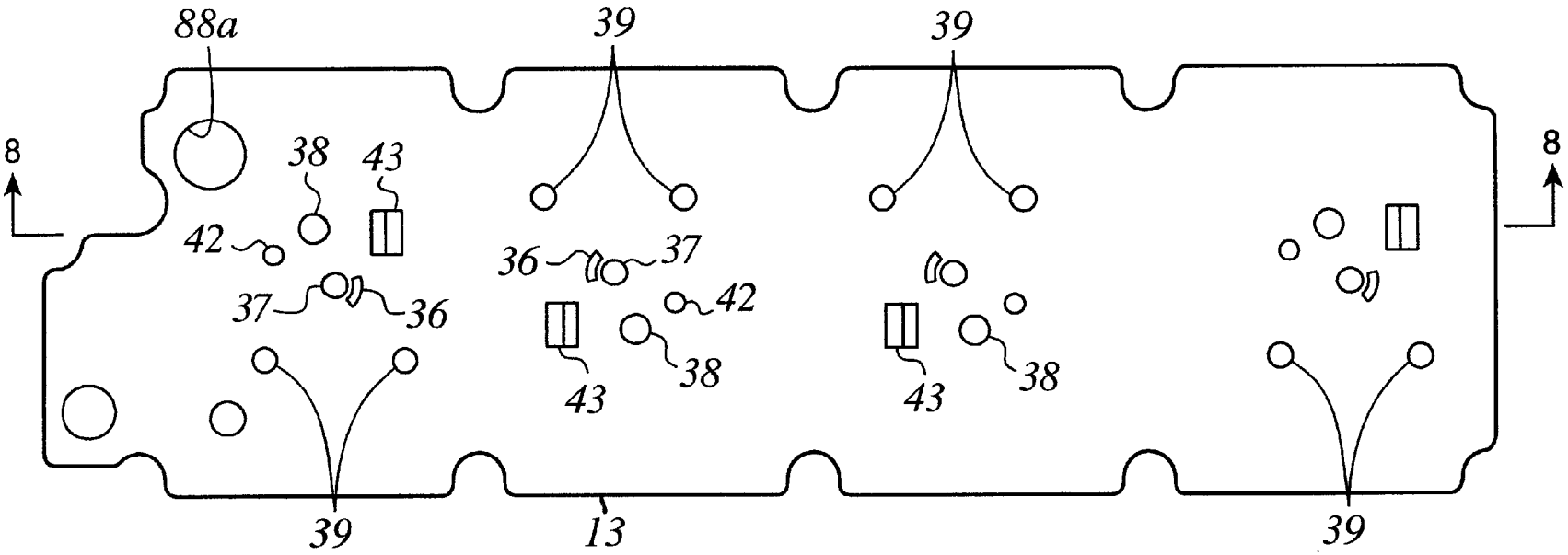
FIG. 7 is a bottom plan view of a seal plate of the module of FIG. 1.
Figure 8:
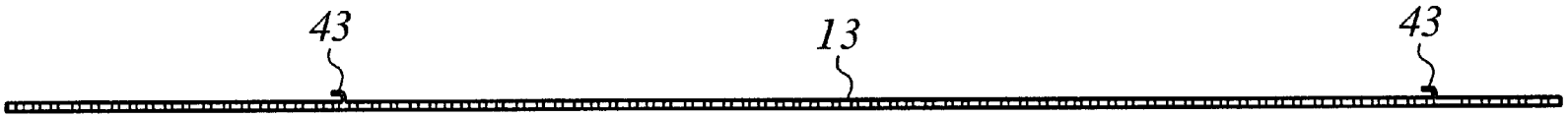
FIG. 8 is a cross-sectional view of the seal plate taken in the plane 8—8 indicated in FIG. 7.
Figure 9:
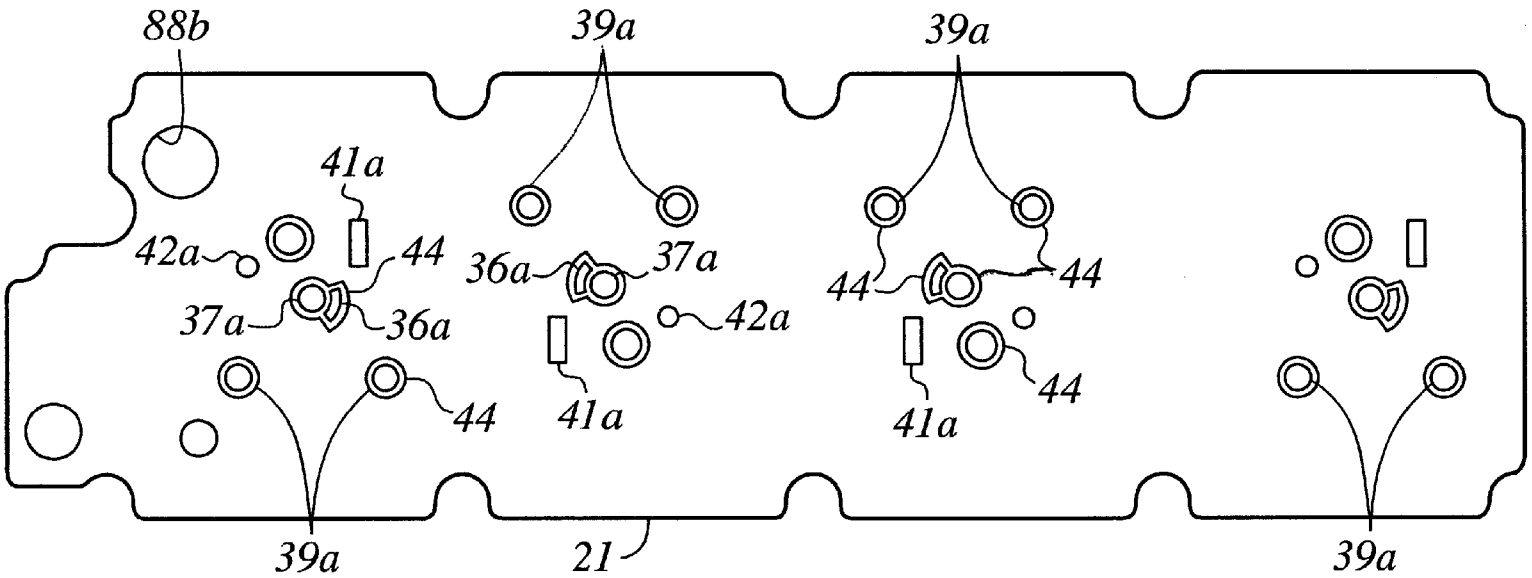
FIG. 9 is a bottom plan view of a gasket seal plate assembly.

The seal plate 13 (FIG. 7) and the gasket seal plate 21 (FIG. 9) have profiles that are substantially the same and that are slightly smaller than the peripheral sealant trails 33 on the top plate 12. This geometry enables the sealant in the peripheral top plate trails 33 to seal on the surface of the engine block surrounding the valley between the cylinder banks. The seal plate 13 and gasket seal plate 21 also have patterns of coincident or aligned holes (or tabs in the case of the seal plate) that are substantially the same and are in alignment. For the most part, these holes (or tabs) provide for hydraulic fluid flow or serve functions for mounting of the solenoids 16 on the plate assembly 11. More specifically, most of the holes (or tabs) in the seal and gasket seal plates 13, 21, are in repeated patterns, each pattern being associated with a solenoid 16 and valve center or station 23. A study of FIG. 3 shows that the solenoids 16 have two different orientations and, consequently, the pattern of oil flow holes or ports 36, 36*a*, 37, 37*a*, 38, 38*a*, 39 and 39*a*, and solenoid mounting holes 41*a*, 42, 42*a* (or tabs 43) have the same two different orientations. The gasket seal plate 21 has elastomeric seals 44 molded in place in a known manner on both of its faces around and in the oil flow holes 36*a*–39*a*. Holes or ports 36, 36*a*, 37 and 37*a* in the seal plate 13 and gasket seal plate 21 supply oil to and from a respective solenoid 16 and holes 39, 39*a*, as discussed below, conduct control pressure to pin tower structures in the engine for disabling associated intake and exhaust valves. The holes 39, 39*a* lie under and communicate directly with respective control trails 26.

Figure 10:
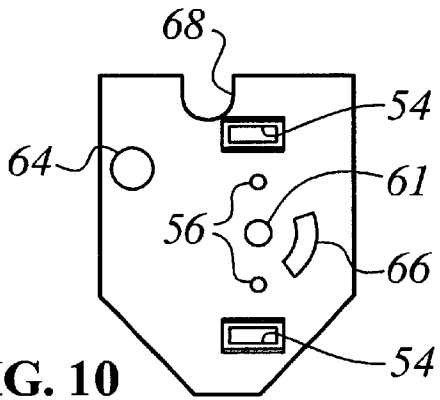
FIG. 10 is a bottom plan view of a typical pole plate.
Figure 11:
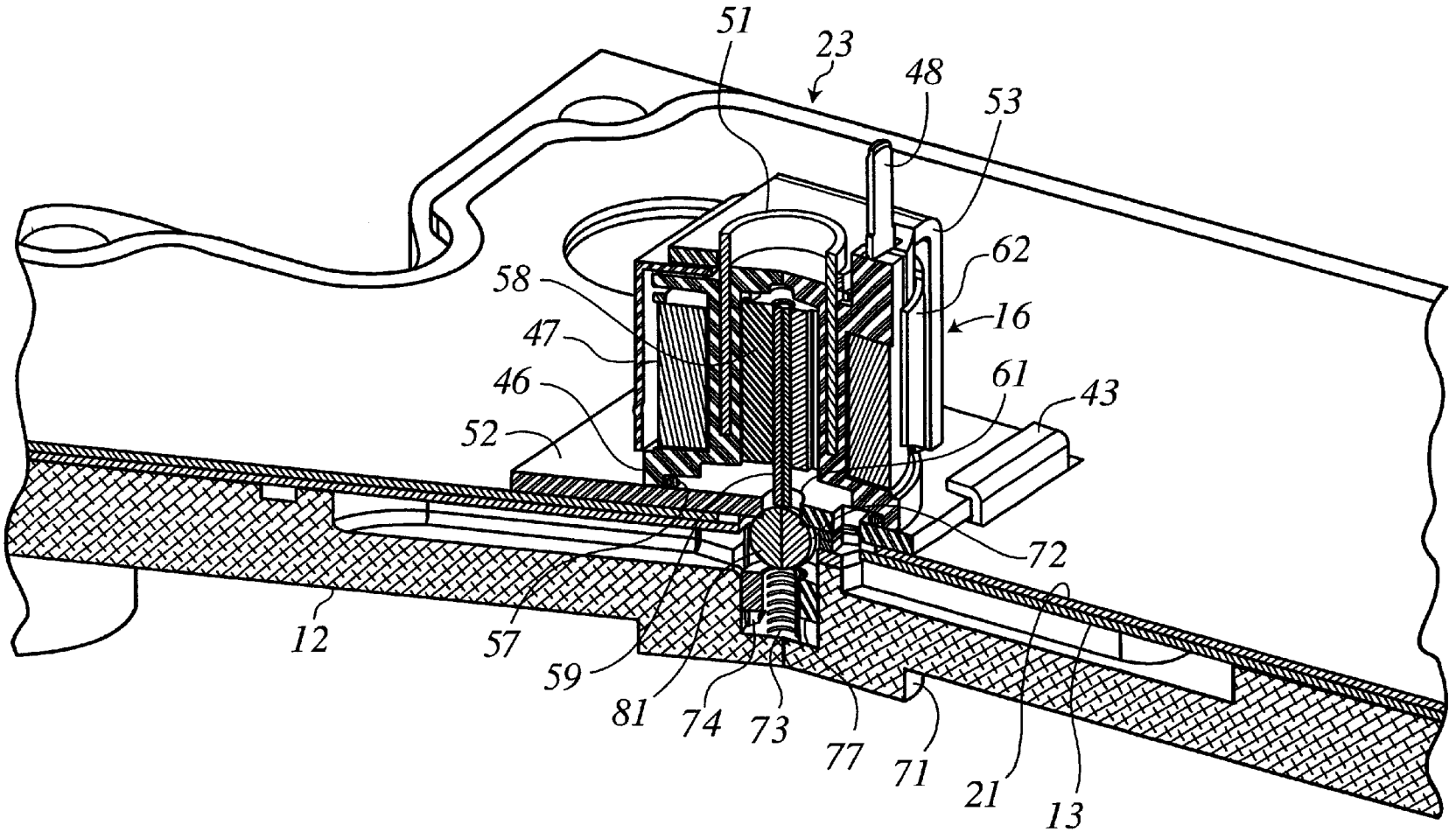
FIG. 11 is a cross-sectional inverted view of a typical valve station taken in the bent plane indicated in FIG. 3 at 11—11 with a connector frame omitted for clarity.

The solenoids 16, which are preferably identical, are generally conventional in construction. With particular reference to FIG. 11, the solenoids 16 are assemblies that include an injection molded plastic bobbin 46 on which is wound an electrical winding 47 connected to terminals 48 extending out of the bobbin. A steel sleeve 51 disposed on the bobbin 46 concentrates the magnetic field produced by the bobbin winding 47. The solenoid assembly 16 also includes a magnetic pole plate 52 (FIG. 10) of suitable steel and a magnetic steel yoke 53. The bobbin 46 is secured to the pole plate 52 with tabs integrally formed on the yoke. The tabs are assembled through holes 54 in the pole plate 52 and are plastically deformed to lock these elements in place. Small holes 56 in the pole plate 52 receive short bosses (not shown) molded in the bobbin for alignment purposes. An elastomeric O-ring 57, concentric with the axis of the coil or winding 47, forms a seal between the pole plate 52 and the bobbin 46. An armature 58 is disposed in and coaxial with the bobbin 46. The armature 58 includes a coaxial projecting pin 59 that is proportioned to extend into the center of a valve seat hole 61 in the pole plate 52. The main body of the armature 58 can be hollow and the pin 59 can be assembled and permanently locked in position in the main body in a known manner. The windings 46 are protected by a suitable injection molded thermoplastic insulator 62.

The solenoid assembly 16 of the bobbin 46, armature 58, yoke 53, pole plate 52 and insulator 62 is assembled to the plate assembly 11 by slipping an edge of the pole plate in the throat of a right angle tab 43 that depends (in the working orientation) from the seal plate through the gasket seal plate 21. A bolt is thereafter assembled through a hole 64 in the pole plate 52, aligned holes 42*a*, 42 in the gasket seal plate 21 and seal plate 13, respectively, and threaded into a blind hole in the top plate 12 to thereby hold the solenoid assembly 16 in place against the gasket seal plate as well as the plates 21, 13 and 12, together. When the pole plate 52 is assembled against the gasket seal plate 21, an inlet hole 66, the valve seat hole 61, and a slot 68 register with holes 36, 36*a*, 37, 37*a*, 38, 38*a* in the seal plate 13 and gasket seal plate 21, respectively.

Figure 5B:
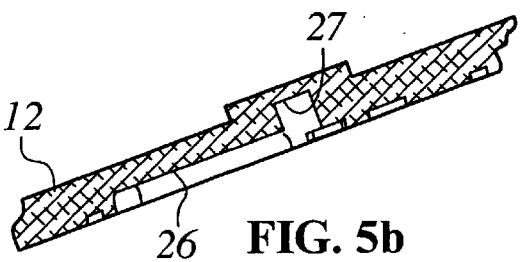
FIG. 5*b* is a fragmentary cross-sectional view of the top plate taken in the plane 5*b*—5*b* indicated in FIG. 5 with an exhaust plug removed for clarity.

At each of the several valve centers or stations 23, an integral boss 71 is cast on the top plate 12 to provide increased wall thickness or height for reception of a valve ball 72 and valve spring 73 and increased height of the exhaust worm trail 27 (FIG. 5*b*) compared to the height of the supply and control trails 24, 26.

Figure 12:
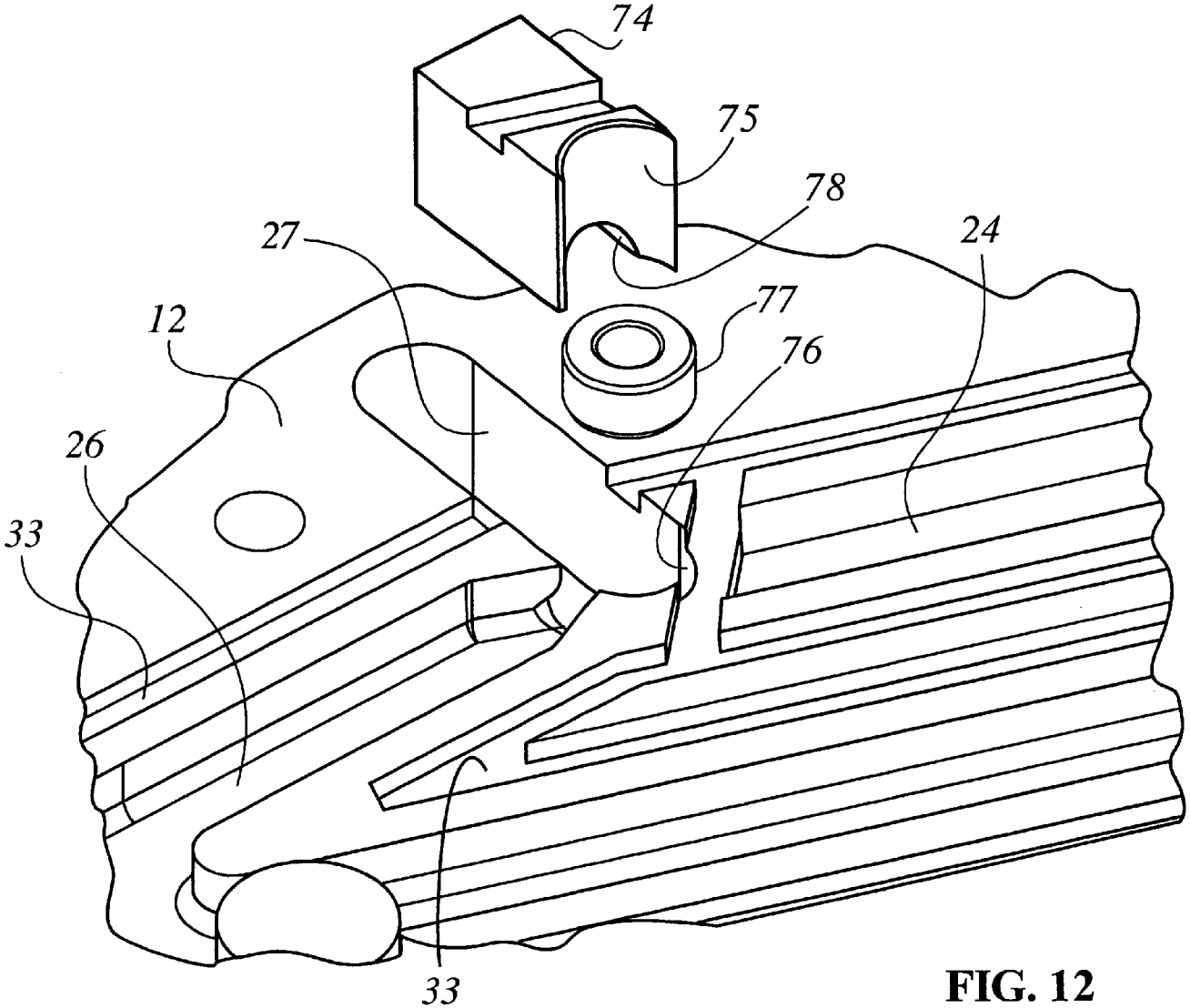
FIG. 12 is a fragmentary exploded view from below of a portion of the top plate and a typical exhaust plug.

With reference to FIG. 12, an exhaust plug 74 is pressed fluid tight into an exhaust trail 27. A cylindrical surface segment 75 cooperates with an opposed end surface 76 of the trail 27 to form a cylindrical pocket. A cylindrical ring-like exhaust valve seat 77 is pressed, fluid tight, into the pocket between the exhaust plug 74 and surface 76. A cylindrical surface 78 on a top face (in the working orientation) of the exhaust plug 74 is a boundary for a passage for exhaust flow coming through the center of the exhaust seat 77.

The spring 73 resiliently holds the valve ball 72 against a circular edge 81 of the pole plate hole 61 and the hole edge 81 serves as a valve seat for supply flow. The hole edge 81 can be slightly counter-sunk or otherwise formed to improve its sealing function.

The connector frame 17 extends lengthwise of the plate assembly 11 under the solenoids 16. The connector frame 17, injection molded of suitable plastic material, has individual electrical conductor strips insert molded on its upper face (in the working orientation) that are arranged to contact the terminals 48 of the solenoids 16. One of the conductor strips can be common to one terminal of each of the solenoids 16. The connector frame 17 has holes molded in it at appropriate locations to allow the terminals 48 to extend through it to assure contact with an associated conductor. One end of the conductor frame is arranged to mate with the multi-conductor connector 18 that extends through aligned holes 88, 88*a* and 88*b*, in the top plate 12, seal plate 13 and gasket seal plate 21, respectively, and snaps into assembled position with suitable barbs. Conductors in the connector 18 individually join the conductors of the connector frame 17 to a mating connector (not shown) of a branch of a wiring harness of the engine.

The module 10 is installed on an engine by positioning it over the valley between the banks of cylinders and securing it in place with bolts assembled through peripheral holes 91 in the top plate 12. Sealant in the trail 33 surrounding the supply port 22 seals around a mating port on the engine block that supplies pressurized engine lubrication oil to the module 10. The gasketted holes 39*a* in the gasket seal plate 21 are positioned to overlie and seal on flat end faces of hollow pin towers rising from the central area of the engine valley. The towers carry oil between the module 10 and spring biased pins that are operable to connect or disconnect intake and exhaust valves to disable their associated piston cylinders. When oil in the towers is at a low pressure, the spring bias on the pins cause the pins to move to connect the intake and exhaust valves to their driving elements. When the pressure of the oil in the towers is elevated, the spring bias force on the pins is overcome and the pins are moved by the oil pressure to disconnect the intake and exhaust valves from their driving elements. It will be understood, thus, that when oil in the control trails 26 is pressurized, the intake and exhaust valves of the engine and the cylinders associated with them will be deactivated.

In operation of the engine, pressurized engine oil is delivered from a passage to the inlet or supply port 22. This supply oil is regulated by the pressure relief valve 31 connected to the supply port by the trail 24 and is monitored by the sensor 32 communicating with this trail.

Figure 5A:
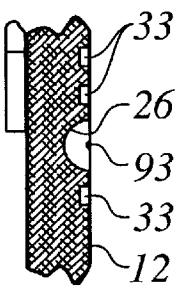
FIG. 5*a* is a fragmentary cross-sectional view of the top plate taken in the plane 5*a*—5*a* indicated in FIG. 5.
Figure 6:
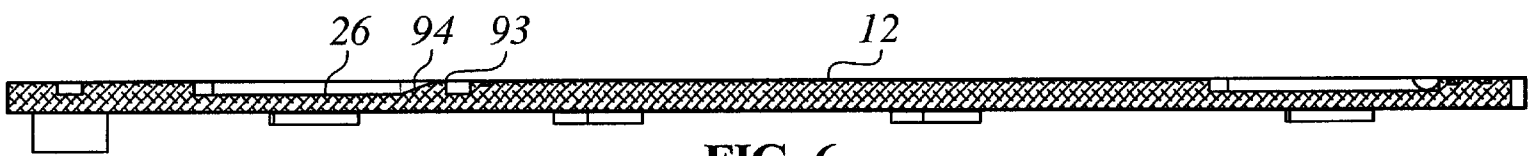
FIG. 6 is a longitudinal cross-sectional view of the top plate taken in the plane 6—6 indicated in FIG. 5.

Small quantities of pressurized oil pass through a bleed orifice 93, associated with each valve station 23. The bleed orifice 93 has a relatively small minimum cross-sectional area (FIG. 5*a* and FIG. 6). By way of example, the bleed orifice 93 can be a semi-circular passage having a radius of 0.50 mm. Flow through the bleed orifice 93 reduces air bubbles in the respective control trails 26 and associated engine valley pin towers. This reduction in the presence of air improves the time response of the hydraulic circuitry. Transitional areas 94 between the bleed orifice 93 and associated control trail 26 in the form of half conical areas that expand laterally from the bleed orifice ensure that oil flow is distributed across the full width of the control trail to flush away air bubbles which might exist at the corners of the trails formed with the seal plate 13. It will be seen that oil in the control trails 26 is maintained above the pressure in the exhaust trails 27 by the head (height) of the oil column that exists in the exhaust circuit beyond the valve station 23. The bleed orifice 93 is situated to produce a continuous flow that sweeps across the pin towers below the holes 39a and 39 associated with the control trail 26. Moreover, the bleed orifice 93 is situated such that it produces a flow in a direction that assists evacuation of pressure in the pin towers and control trail 26 when quick response is most important when full engine power is demanded and the control trail is connected to the exhaust trail 27.

When the engine is under load, the engine control module maintains all of the cylinders in operation. When the engine is under a light load, the engine control module can ordinarily deactivate two or four cylinders by electrically energizing two or four of the solenoids 16. Generally, though not necessarily, cylinders are deactivated in pairs for smoothest operation. At each valve station 23, before a solenoid 16 is actuated the valve spring 73 holds the ball valve 72 against the valve seat formed by the edge 81 of the pole plate hole 61. The force of the spring 73 is sufficient to maintain the ball valve 72 closed on the seat 81 against the supply pressure existing in the space around the armature 58 by way of the arcuate holes 36, 36*a* and 66 in the seal plate, gasket seal plate and pole plate from the supply trail 24 with which these holes communicate. At this time, any shunted supply flow through the bleed orifices 93 and the control trails 26 passes through the exhaust valve seat 77, over the exhaust plug surface 78 in the exhaust trail 27 and out of the exhaust holes 38, 38*a* and notch 68 in the seal plate, gasket seal plate and pole plate, respectively, and down into the valley of the engine block.

When the engine control module energizes a solenoid 16, its armature 58 overcome the force of the spring 73, opening the respective ball valve 72 off of the pole plate valve seat 81 and closes the ball valve against the exhaust seat 77. The result is that supply pressure passing from the supply port 22 through the armature area of the solenoid 16 and out of the valve seat 81 is applied to the associated control trail 26. Since the exhaust seat 77 is closed, full supply pressure is developed in the control trail 26 and, therefore, in the engine pin towers connected to the associated ports or holes 39, 39*a*. As indicated above, supply pressure in the towers shifts pins to disengage associated intake and exhaust valve drive mechanism thereby deactivating the respective cylinders.

By disposing the valve seats 77 and 81 adjacent or in the planes of the plates 12, 13, the module can be advantageously constructed economically and with a relatively low profile which can be important in engine and vehicle design.

Figure 13:
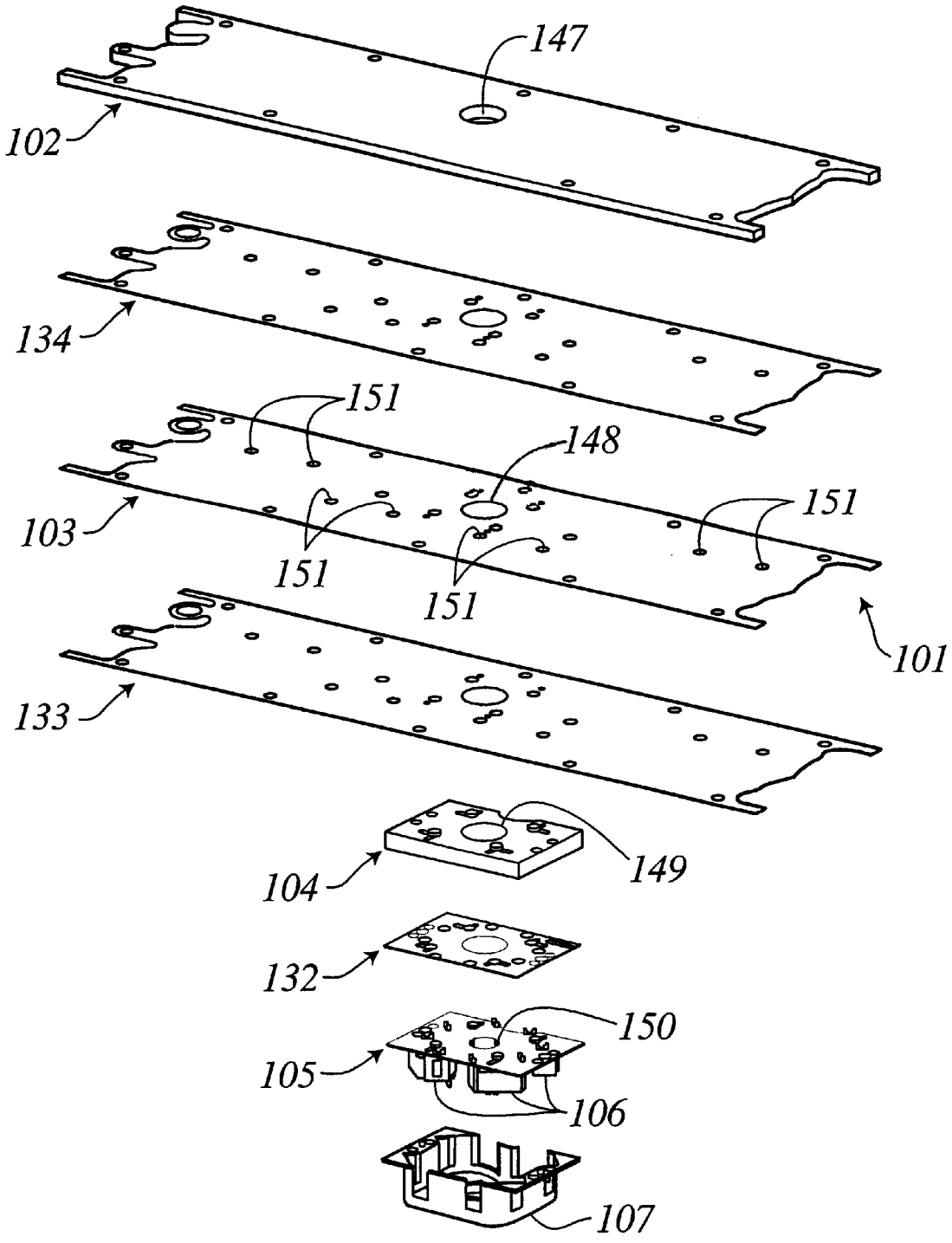
FIG. 13 is an exploded isometric view of an electro-hydraulic control module constructed in accordance with a second embodiment of the invention.
Figure 14:
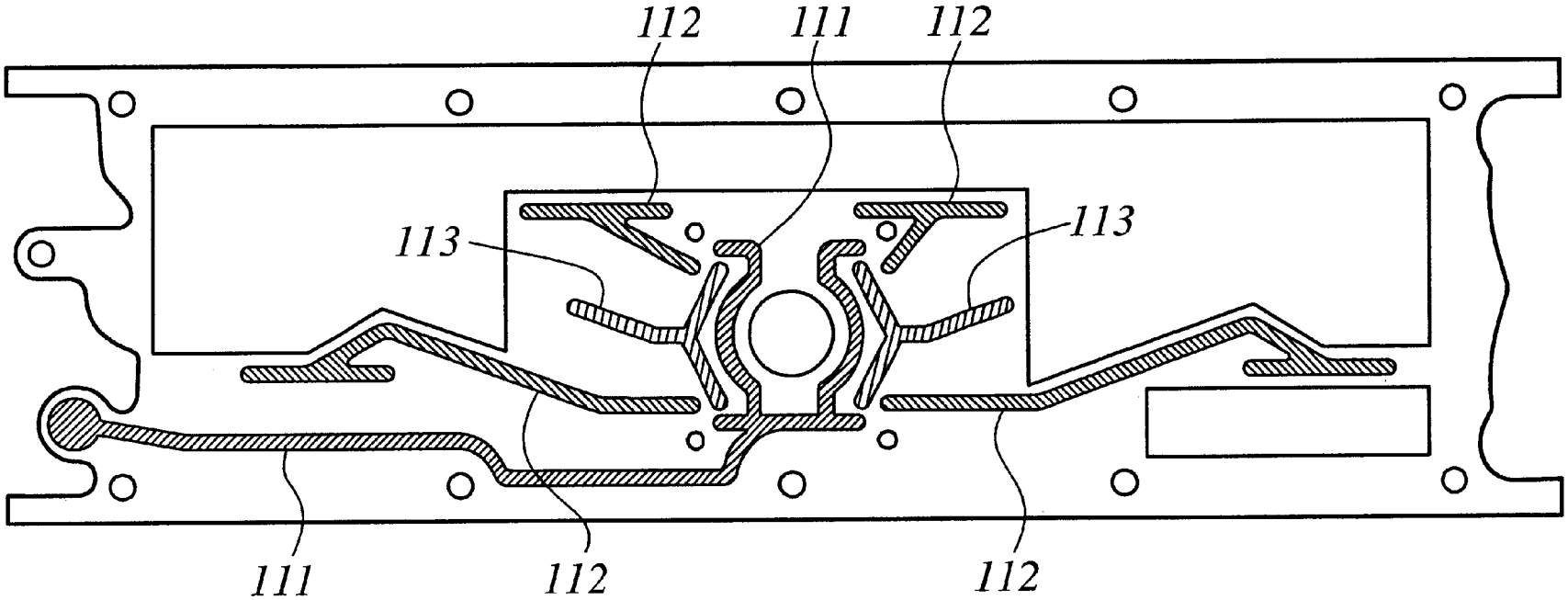
FIG. 14 is a somewhat schematic bottom view of a top plate of the module of FIG. 13 showing worm trails for supply, control and exhaust pressures.
Figure 15:
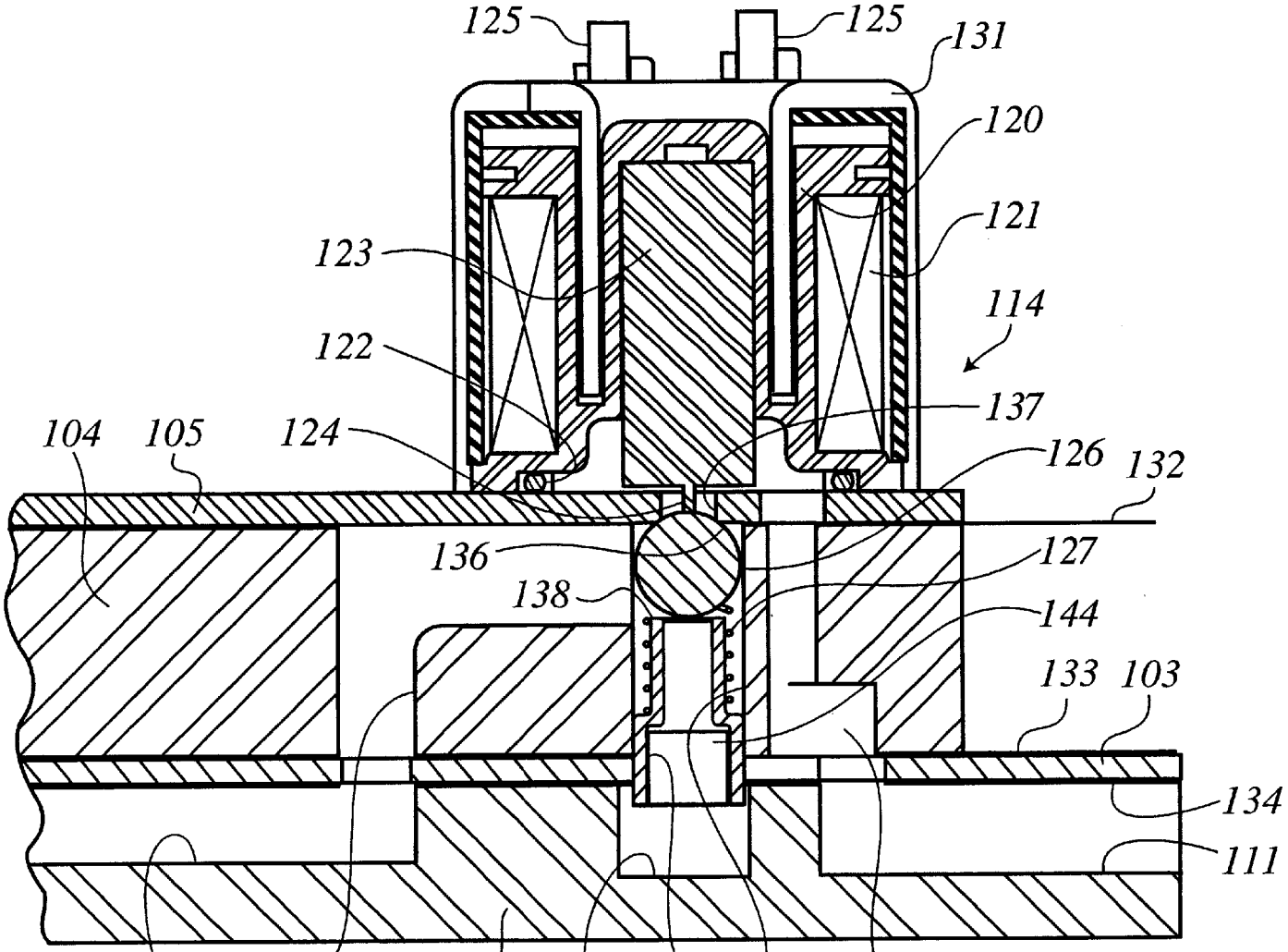
FIG. 15 is a schematic view of a typical valve and solenoid of the module of FIG. 13 in an inverted orientation.

FIGS. 13 through 15 illustrate a second embodiment of an electro-hydraulic module 101 of the invention. FIG. 13 shows an exploded isometric view of the module 101. The module 101 includes a top plate 102, seal plate 103, valve body or plate 104, pole plate 105, solenoids 106 and connector frame 107. The top plate 102 in a manner similar to that described above for the top plate 12 has grooves or trails 111, 112 and 113 for supply, control and exhaust functions, respectively. As indicated in FIG. 13 the electro-hydraulic module 101 is characterized by an arrangement wherein the solenoids 106 (and their associated valve elements discussed below) are grouped near the center of the plates 102, 103 and wherein the solenoids 106 share a common pole plate 105. FIG. 15 is a diagrammatic representation of a typical solenoid 106 and associated valve section 114 in the valve body 104. The solenoid 106 has an injection molded plastic bobbin 120 on which a coil 121 is wound. The bobbin 120 is sealed with the pole plate by an O-ring 122. An armature 123 including a central pin 124 is responsive to the magnetic field of the coil 121 when the latter is electrically energized to displace a ball valve 126 of the valve section 114 against the force of a spring 127. The solenoid includes a yoke or housing 131 having tabs received and locked in holes in the pole plate 105 to fix the solenoid 106 on the pole plate 105 in the general manner described above in connection with the yoke 53. Suitable gaskets 132, 133 and 134 of paper or other known material are disposed between the pole plate 105 and valve body 104, the valve body and the seal plate 103, and the seal plate and the top plate 102.

The valve section 114 associated with each solenoid 106 includes, besides the ball valve 126 and spring 127, a control valve seat 136 formed at the edge of a hole 137 in the pole plate 105 through which the armature pin 124 operates and an exhaust valve seat 138 on an end of a tubular insert 139. The insert 139 which supports the spring 127 is pressed in a bore 141 in the valve body 104; the position of the exhaust seat 138 relative to the control seat 136 can be precisely set by gauging the position of the insert 139 for improved valve performance. For each valve section 114, the valve body 104 has supply, control and exhaust passages 142, 143 and 144, respectively, that align with corresponding supply, control and exhaust trails 111, 112 and 113, respectively. Operation of a valve section 114 is like that described in connection with the valves of the module 10.

The solenoids 106 are individually connected to separate wires in a wiring harness (not shown) by the connector frame 107. The connector frame 107 is an injection molded plastic body that has separate conductors that are engageable with the terminals 125 of the solenoids 106. The conductors, which are preferably insert molded in the body of the connector frame 107 preferably have integral connector formations that can mate with conductors in a multiple pin or blade connector inserted through central holes 147, 148, 149 and 150 in the top plate, seal plate, valve body and pole plate 102–105, respectively. The insert molded conductors and integral connectors in the connector frame can be stamped from flat metal stock such as beryllium copper. The connector frame 107, besides electrically connecting the solenoids 106 to the engine control module, serves to prevent screws holding the pole plate 105 and valve body 104 to the plates 102, 103 from backing out of threaded blind holes in the top plate 102 and falling into the engine valley. The connector frame 107 is preferably held against the pole plate by screws (not shown). Holes or ports 151 in the seal plate 103 align with the top end faces of pin towers extending upwardly in the engine valley to the plane of the module 101 to connect the control trails 112 to such towers.

It will be understood that, with respect to the embodiment of FIGS. 1–12, the sealant molded in the trails 33 and the sealant around the holes on the gasket seal plate are relatively inexpensive compared to O-rings and can seal against planar surfaces without the need for lateral constraint such as a countersunk hole or other formation which would be required by an O-ring. It is contemplated that gaskets similar to those shown in the embodiment of FIGS. 13–15, which also seal against planar surfaces without lateral restraint, can be substituted in the embodiment of FIGS. 1–12 for the molded sealant and vise versa. It is also contemplated that the exhaust plug 74 and exhaust seat 77 can be integral.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. An electro-hydraulic control module for hydraulically deactivating and reactivating the intake and exhaust valves of a V-block internal combustion engine comprising a plurality of solenoid operated hydraulic valves, a plate assembly being adapted to bridge across the valley of the V-block engine and supporting said solenoid operating valves in the valley, the plate assembly including worm trails for conducting engine lubricating oil from a supply to a plurality of said hydraulic valves.

2. A control module as set forth in claim 1, wherein the worm trails in the plate assembly include control passages for conducting oil between said plurality of hydraulic valves and separate ports adapted to connect with pin towers rising in the valley of the block.

3. A control module as set forth in claim 2, including a bleed orifice for supplying a small flow of oil through each of said control passages and over said separate parts whereby the presence of air in said control passages and pin towers is reduced.

4. A control module as set forth in claim 1, wherein said worm trails in the plate assembly include passages for conducting oil from said plurality of hydraulic valves to exhaust ports adapted to deliver exhaust oil to the valley of the engine block.

5. A control module as set forth in claim 1, wherein said worm trails are formed in a single plate.

6. A control module as set forth in claim 5, wherein said single plate is a top plate when the module is in a working orientation.

7. An electro-hydraulic control module for hydraulically deactivating and reactivating intake and exhaust valves of a multi-cylinder internal combustion engine comprising a plurality of hydraulic valves and solenoids for operating said hydraulic valves, a plate assembly including a plurality of plates for supporting said hydraulic valves and their respective solenoids, the hydraulic valves including a ball valve and opposed valve seats on opposite sides of the ball valve, the valve seats being carried in separate plates that are in superposed relationship.

8. A control module as set forth in claim 7, wherein one of said plates has an exhaust passage disposed between said seats.

9. A control module as set forth in claim 7, wherein said plates have generally planar faces sealed by gaskets compressed against said planar faces to seal a zone surrounding the ball valve at said plurality of hydraulic valves.

10. A control module as set forth in claim 9, wherein said plates include a pole plate structure of reach of said solenoids, one of said valve seats being formed by a hole in a pole plate structure of the respective solenoid.

11. A control module as set forth in claim 10, wherein said pole plate structure has a second hole for a hydraulic circuit that includes said valve seat.

12. An electro-hydraulic control module for hydraulically deactivating and reactivating the intake and exhaust valves of a multi-cylinder internal combustion engine comprising a plurality of hydraulic valves and solenoids for operating said hydraulic valves, a plate assembly including a plurality of plates, said plates having parallel planar surface areas, the solenoids having an armature with a line of movement perpendicular to the planar surface areas of the plates, each hydraulic valve having valve seats within the planes of the plates and a ball valve between the valve seats, and seals between the plates.

13. A control module as set forth in claim 12, wherein one of said plates at each hydraulic valve is a pole plate of a respective solenoid.

14. A control module as set forth in claim 12, wherein the pole plate at each hydraulic valve has an integral valve seat.

15. A control module as set forth in claim 14, wherein the pole plate at each hydraulic valve has an in let port .

16. A control module as set forth in claim 12, wherein said plates have separate passages for supply, control and exhaust functions.

17. A control module as set forth in claim 16, wherein said control passage is at a plane between said seats.

18. A control module as set forth in claim 16, wherein the control passage, adjacent a ball valve, is formed by a pair of plates.

19. An electro-hydraulic control module for hydraulically deactivating and reactivating intake and exhaust valves of an internal combustion engine comprising a plurality of solenoid operated hydraulic valves, a plate assembly for supporting said solenoid operated hydraulic valves, the plate assembly including worm trails for supply, control and exhaust flow of engine lubricating oil to and from the hydraulic valves, the worm trail for one of the exhaust and supply flows being deeper than the control trail, and a plug in said one trail for enabling flow through an associated valve seat in a first direction to be redirected in the plate providing said one trail to a direction opposite said first direction.

20. A control module as set forth in claim 19, wherein said one trail conducts exhaust flow.

21. A control module as set forth in claim 19, wherein said plug is assembled in said providing plate from a face of said providing plate in which said one trail is formed.

* * * * *